US008376041B2

(12) United States Patent
Shampine et al.

(10) Patent No.: US 8,376,041 B2
(45) Date of Patent: Feb. 19, 2013

(54) APPARATUS AND METHOD FOR ENGAGING A TUBULAR

(75) Inventors: Rod Shampine, Houston, TX (US); Jean-Louis Pessin, Houston, TX (US); Joseph K. Flowers, Houston, TX (US); Robin Mallalieu, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 8 days.

(21) Appl. No.: 12/048,335

(22) Filed: Mar. 14, 2008

(65) Prior Publication Data

US 2008/0302530 A1 Dec. 11, 2008

Related U.S. Application Data

(60) Provisional application No. 60/942,803, filed on Jun. 8, 2007.

(51) Int. Cl.
*E21B 19/22* (2006.01)

(52) U.S. Cl. ..... 166/77.1; 166/77.53

(58) Field of Classification Search ..... 166/77.1, 166/77.2, 77.3, 77.53; 294/902
See application file for complete search history.

(56) References Cited

U.S. PATENT DOCUMENTS

| | | | | |
|---|---|---|---|---|
| 2,247,032 | A * | 6/1941 | Norton | 285/321 |
| 4,844,165 | A | 7/1989 | Van Der Steeg | |
| 4,940,095 | A * | 7/1990 | Newman | 166/378 |
| 5,435,395 | A | 7/1995 | Connell | |
| 5,515,926 | A * | 5/1996 | Boychuk | 166/379 |
| 5,875,848 | A | 3/1999 | Wolff et al. | |
| 5,890,534 | A | 4/1999 | Burge et al. | |
| 5,988,274 | A * | 11/1999 | Funk | 166/77.4 |
| 6,056,055 | A | 5/2000 | Falconer et al. | |
| 6,192,981 | B1 | 2/2001 | Boquet et al. | |
| 6,209,652 | B1 | 4/2001 | Portman et al. | |
| 6,328,111 | B1 | 12/2001 | Bearden et al. | |
| 6,543,538 | B2 | 4/2003 | Tolman et al. | |
| 6,688,394 | B1 * | 2/2004 | Ayling | 166/380 |
| 6,776,230 | B2 | 8/2004 | Collie et al. | |
| 6,896,076 | B2 * | 5/2005 | Nelson et al. | 175/57 |
| 7,188,683 | B2 * | 3/2007 | Ayling | 175/57 |
| 2006/0124314 | A1 | 6/2006 | Haheim et al. | |
| 2007/0272414 | A1 | 11/2007 | Palmer et al. | |

FOREIGN PATENT DOCUMENTS

| | | | |
|---|---|---|---|
| EP | 0067409 | B1 | 12/1982 |
| EP | 0109830 | A2 | 5/1984 |
| EP | 0862682 | B1 | 9/1998 |
| EP | 0911483 | B1 | 4/1999 |
| EP | 1208283 | B1 | 5/2002 |
| EP | 1305501 | B1 | 5/2003 |

(Continued)

*Primary Examiner* — William P Neuder
*Assistant Examiner* — Kipp Wallace
(74) *Attorney, Agent, or Firm* — Myron K. Stout; Michael Flynn; Robin Nava

(57) ABSTRACT

An apparatus for engaging with an outside diameter of a tubular comprises a device body having an internal surface that defines an internal diameter in a first position and allowing the tubular to pass therethrough and an actuator operable to move the internal surface of the device body from the first position to a second position, the second position defining an internal diameter less than the first position internal diameter. The internal surface of the device body is sized with a predetermined grip length for engaging with the outside diameter of the tubular. The grip length is determined by a function of the outside diameter of the tubular and the coefficient of friction between of the outside diameter of the tubular and the interior surface of the device body and the device body is operable to engage with a tubular having a predetermined range of outside diameters.

28 Claims, 7 Drawing Sheets

FOREIGN PATENT DOCUMENTS

| | | | |
|---|---|---|---|
| EP | 1647668 | A1 | 4/2006 |
| GB | 1512658 | | 6/1978 |
| GB | 2347156 | A | 8/2000 |
| GB | 2409692 | A | 7/2005 |
| WO | 9834005 | | 8/1998 |
| WO | 0214651 | A1 | 2/2002 |
| WO | 2004003338 | A1 | 1/2004 |
| WO | 2004065757 | A2 | 8/2004 |
| WO | 2006003362 | A1 | 1/2006 |
| WO | 2006010906 | A1 | 2/2006 |
| WO | 2006096069 | A1 | 9/2006 |

* cited by examiner

APPARATUS AND METHOD FOR ENGAGING A TUBULAR

CROSS REFERENCE TO RELATED APPLICATIONS

This application is entitled to the benefit of provisional patent application U.S. 60/942,803 filed Jun. 8, 2007, the entire disclosure of which is incorporated herein by reference.

BACKGROUND OF THE INVENTION

The present invention relates generally to tubular and downhole tool deployment systems and methods and, in particular, to riserless deployment systems.

In the course of constructing and maintaining oil and gas wells it is often necessary to convey various types of tools into the well. Many types of conveyance are commonly used, as are many types of tools. The most common types of conveyance, in order of increasing cost and decreasing speed of conveyance are: slickline, wireline, coiled tubing, snubbing units, workover rigs, and drilling rigs. The tools used on wells range from very short lengths (under one foot) to arbitrary lengths only limited by the method of putting them in the hole (as high or long as 3000 feet).

In many cases, the well does not have any wellhead pressure (a dead well or a well requiring pumping or other enhanced recovery methods) when the tools are placed in the well or the flow coming out of the well is small enough that the quantity of well bore fluids coming out can be collected or diluted enough to allow the deployment operation to continue as in a dead well. This type of operation is very quick and simple and the tools are typically supported during this operation by slips, a gripping band (also known as a wedding band) or by a C-plate. Slips consist of a set of segments with an external taper and an internal diameter close to the diameter of the tool section. These are placed in a matching tapered slip bowl. The taper combined with the weight of the tool causes them to move inward and grip the tool. With the proper combination of gripping surfaces and tapers the tool will be held reliably. A wedding band has a set of segments that can conform to the outside of the tool and a mechanism to tighten them circumferentially around it. With the correct combination of gripping surfaces and adequate tension in the band, the tool will be held reliably. A C-plate is a large washer with a slot cut through it matching the inside hole. This is slid around the tool and a shoulder on the tool bears on the washer. A keeper is often provided to prevent the tool from moving off of the center line of the C-plate. The tool can be inserted a section at a time, with the length limited by the lifting mechanism (typically a crane). Once a section is lowered into the well, the gripping means is set on the outside of the tool. Then, the lifting means is removed, leaving the tool hanging in the well. The next tool section is lifted and then attached to the section already hanging. The entire tool string is lifted slightly and the gripping means is released. Then, the tool string is lowered in and the gripping means is re-set on the tool. Once the entire tool is inside the well, the conveyance system is attached to it and the tool is run into the well.

For wells that have well head pressure, some method of getting the tools connected to the conveyance method and inside the pressure barrier is required. In order of decreasing frequency and increasing difficulty, the current methods are: direct riser deployment, indirect riser deployment, and pressurized connection.

In the direct riser deployment method, a riser is assembled that can contain the entire tool string. In no particular order the riser is assembled, the tool is installed in the riser, and the conveyance method is connected to the tool. Once everything is assembled and attached to the blowout preventers (BOPs) and the well head, the equipment is pressure and pull tested. Then, the riser pressure is equalized with the well and the well head valves are opened. The tool is then run into the well. The procedure is reversed at the end of the job. This method is quite efficient for short tool strings and for longer tool strings with low force conveyance methods (wireline and slickline) that do not require heavy equipment at the top of the riser. As riser lengths increase and heavy equipment is installed on the top of the riser, this method becomes difficult and dangerous.

The indirect riser deployment method splits the tool string into at least two pieces, which may have very different lengths. A riser is used to contain the first tool section. The top of the tool section is provided with a deployment bar with an outside diameter that matches the gripping and sealing diameters of at least one BOP (two may be used at high pressures) and has a connector on the top of it that can be disconnected. Some means must be provided to prevent any well bore fluids from coming through the deployment bar. In the case of purely electrical tools this is easily accomplished. This can be much more difficult in the case of flow through tools. One or more Kelly cocks and/or check valves are used in the case of a single flow through passage. A Kelly cock is an inline ball or plug valve with tool joint threaded ends. In the case of tools with more than one fluid passage through the joint (such as a straddle packer system with an equalizing line to balance the pressure above and below the straddle packer system), there are no commercially available valve assemblies to shut off the passages during deployment.

The first section of the tool is deployed in a manner identical to that of the direct riser method. Once the tool has been lowered such that the deployment bar is located across the appropriate BOP rams, the rams are closed. Pressure and/or pull tests are generally performed. The riser pressure is bled off and the conveyance method is disconnected from the first tool section above the deployment bar (and Kelly cock(s) if present). This disconnection is either accomplished by disconnecting the riser and lifting it to access the connection area or by using a device called a window to safely access the area. A window is a device that can support axial load at all times, but that has a section of the pressure barrier that can be opened and moved out of the way (generally upward) to gain access to the inside.

A special riser with a sliding section is also commercially available that allows the lower section of the riser to be slid upward onto the upper section, thus exposing the connection area without moving the conveyance method. However, this telescoping riser does not carry axial load when it is sliding and it can only contain pressure in its fully extended state. Once the conveyance method is disconnected, any number of additional tool sections may be attached to the conveyance method, installed in the riser, attached to the top of the deployment bar, be deployed, and hung off in the BOPs. The number of tool sections is limited only by the gripping capacity of the BOP (very high), the tensile strength of the deployment bar, and the lifting capacity of the conveyance method (generally the limiting factor).

At this point, a different conveyance method may be used to actually carry the tool down into the well. This is often done in the case of coiled tubing tools as the connection and disconnection step is quite challenging when using coiled tubing. The reasons for this are the residual bend in the coiled tubing pushing the end of the coiled tubing off center, the stiffness of the coiled tubing, and the very high push and pull forces available. Once the tool sections are all in place, the final tool section is attached to the final conveyance method, install in a (usually much shorter) riser, and connected to the deployment bar. Pressure and/or pull tests are generally performed. Once this is done, the riser is equalized with the well head pressure, the BOPs that are holding the deployment bar are opened, and the tool is run down into the well.

This method suffers from many faults. The deployment bars add significant length to the tool string (from three feet each to twelve feet each). Many tools are not suitable for deployment bars or special bars have to be designed. Many tools can only be split in certain places leading to long tool sections that have to be deployed. Some tools can not be used with a Kelly cock. In order for a Kelly cock to be used, the next section of tool must provide a complete pressure barrier above the Kelly cock so that it can be opened with the outside of the tool at atmospheric pressure. One key tool that does not meet this test is a perforating gun. Unfired perforating guns generally do not have a high pressure rated barrier between gun sections, but the gun housing is a very good pressure barrier. Also, the detonating means (generally detonating cord) must be run all the way through the tool and any deployment bars. Once the guns are fired, they do not provide any pressure barrier at all and any pressure barrier that the deployment bars provided has been exploded. This method also has considerable additional personnel risk due to the possibility of ejecting the tool if the correct steps are not followed in the exact sequence.

The final deployment method is generally very similar to the indirect riser deployment method. However, the key difference is that a special BOP is provided along with a special connection means, called a completion insertion and removal under pressure (CIRP) connector. The lower ram of the CIRP BOP can grip the bottom part of a CIRP connector and both locate and support the tool string. The upper ram locks the bottom part of the CIRP connector in place and unlatches the connector. The upper part of the CIRP connector (still attached to the conveyance means) is pulled up and two gate valves are closed, sealing off the well bore. Then, another tool section can be installed in the riser. Once it is in place a pressure and/or pull test is generally performed. The riser pressure is equalized with the well head pressure and the gate valves are opened. The next tool section is conveyed down until the CIPR connector on the bottom of it enters the CIRP connector held in the CIRP BOP. The connector is latched, pull and/or push tested, and the remaining CIRP BOP rams are opened. The tool string is lowered further into the well and the process is repeated at the next connector. This method allows perforating guns to be safely deployed and undeployed since it avoids the need for pressure containing pressure at the deployment section (CIRP connector instead of a deployment bar).

A special method similar to deployment is used in snubbing units. A snubbing unit consists of a fixed slip assembly and a moving slip assembly above it. The moving mechanism is generally capable of providing a very large force in both directions and the two slip assemblies are capable of carrying load in both directions. In these units, a ram type BOP is attached to the well head and a special type of BOP called an annular BOP is attached above it. An annular BOP can seal on a variable diameter and allow the object it is sealed on to move through it. It can generally also seal on an open hole, though this consumes a significant portion of the life of the element to do so. Also, the annular BOP can accommodate variations in the diameter of the object moving through it (such as the upsets on drill pipe). A riser may be provided between the two. The very short tool is inserted through the annular (and possibly the BOP). The upper slip assembly is closed on the drill pipe above the tool. The annular BOP is closed, a pressure test is generally performed, and the well head is opened. The moving mechanism moves the drill pipe downward, forcing the drill pipe through the annular against the wellhead pressure. This procedure is known as snubbing. When the moving mechanism has moved as far as possible, the lower slip is set on the drill pipe. The upper slip is opened and moved upward. The process is repeated.

Additional joints of pipe are torqued on as needed. One or more check valves on the bottom of the drill pipe must hold pressure perfectly if the drill pipe is going to be pumped through. If the drill pipe is only being used as a high force conveyance, the bottom of the drill pipe can be plugged or a sub can be used that doesn't have a hole through it. Snubbing units can be very dangerous to operate and the risk of having the drill pipe ejected due to an error in procedure is significant. This procedure is not capable of deploying anything besides very short, simple tools. If a multi-section tool were to be deployed this way, it would have to have a buckling load similar to the drill pipe and have a sufficiently smooth outside diameter for the annular to slide over it. Also, it could not have any sort of protrusions, grooves, holes, soft materials, etc that could damage the annular element. These requirements rule all but the most basic tools.

Accordingly, a need exists for a system, apparatus, and/or method for providing a tubular deployment apparatus that may reduce and/or eliminate the need for a conventional riser or the like or otherwise improve upon existing deployment methods and systems.

SUMMARY OF THE INVENTION

An apparatus for engaging with an outside diameter of a tubular comprises at least one device body having an internal surface, the internal surface defining an internal diameter in a first position and allowing the tubular to pass therethrough and an actuator operable to move the internal surface of the at least one device body from the first position to a second position, the second position defining an internal diameter less than the first position internal diameter. The internal surface of the device body is sized with a predetermined grip length for engaging with the outside diameter of the tubular. The grip length is determined by a function of the outside diameter of the tubular and the coefficient of friction between of the outside diameter of the tubular and the interior surface of the device and the device body is operable to engage with a tubular having a predetermined range of outside diameters.

Alternatively, the predetermined grip length, L, is determined by the equation $$L = \frac{D}{4\mu},$$

wherein D is the outside diameter of the tubular and μ is the coefficient of friction. Alternatively, the predetermined grip length is further determined by a predetermined pressure below the at least one device body, a predetermined tension force exerted on the tubular, and a predetermined pressure above the at least one device body. Alternatively, at least a pair of device bodies are stacked to define the predetermined grip length. Alternatively, the at least one device body is operable to simultaneously seal and convey the tubular.

Alternatively, the at least one device body is operable to simultaneously seal and grip the tubular. Alternatively, the at least one device body is operable to prevent relative motion of the tubular. Alternatively, the tubular is one of coiled tubing, wireline, a downhole tool, and at least a portion of a drill string. Alternatively, the actuator is selected from the group consisting of a hydraulic actuator, a pneumatic actuator, an electrical actuator, a mechanical actuator, and combinations thereof.

In another embodiment, the present invention provides a system for deploying a tubular in a wellbore comprising at least one device body having an internal surface, the internal surface defining an internal diameter in a first position and allowing the tubular to pass therethrough and a device body actuator operable to move the internal surface of the at least one device body from the first position to a second position, the second position defining an internal diameter less than the first position internal diameter to enable the at least one device body to grip and seal the tubular. The system also comprises a pressure chamber adjacent the at least one device body for testing the seal of the at least one device body and a deploying actuator operable to deploy the tubular, wherein the system is operable to be attached to a wellhead assembly and wherein the at least one device body is operable to engage with a tubular having a predetermined range of outside diameters.

Alternatively, the internal surface of the device body is sized with a predetermined grip length for engaging with the outside diameter of the tubular, the grip length determined by a function of the outside diameter of the tubular and the coefficient of friction between of the outside diameter of the tubular, the interior surface of the device, a predetermined pressure below the at least one device body, a predetermined tension force exerted on the tubular, and a predetermined pressure above the at least one device body. Alternatively, the system further comprises at least one port in fluid communication with the pressure chamber and at least a source of pressurized fluid and wherein the at least one port is operable to adjust the pressure in the pressure chamber to verify the integrity of the seals of the device bodies.

Alternatively, the at least one device body is at least a pair of spaced apart device bodies and wherein the pressure chamber is disposed between the device bodies. The deploying actuator may be operable to move the at least two device bodies with respect to each other and the system may deploy the tubular while one of the device bodies grips the tubular. The pair of spaced apart device bodies may alternately grip and seal the tubular and thereby convey the tubular in at least one wellbore servicing operation, enabling the use of the system as an airlock deployment apparatus. The device bodies may be disposed within the pressure chamber. Relative motion between the device bodies may be utilized to verify the gripping strength of the device bodies. Alternatively, the pressure chamber is a telescopic tube.

In another embodiment, the present invention provides a method for deploying a tubular in a wellbore, comprising providing a system for deploying a tubular, the system comprising at least one device body operable to at least grip and seal the tubular, a pressure chamber, and a deploying actuator to deploy the tubular; attaching the system to a wellhead assembly; inserting the tubular into the system; sealing the tubular with the at least one device body; pressure-testing the system in the pressure chamber; and deploying the tubular into the wellbore.

Alternatively, providing comprises providing at least one of a variable pipe slip, a variable slip ram, and a variable pipe ram to at least grip and seal the tubular. Alternatively, sealing and deploying are performed substantially simultaneously. Alternatively, deploying comprises gripping the tubular with at least one device body and activating the deploying actuator to move the tubular into the wellbore.

Alternatively, the method further comprises purging the pressure chamber and repeating the sealing, pressure-testing, deploying and purging steps until the tubular is deployed into the wellbore. Alternatively, inserting comprises inserting one of coiled tubing, wireline, a downhole tool, and at least a portion of a drill string. Alternatively, providing further comprises providing at least one port in fluid communication with the pressure chamber and at least a source of pressurized fluid and wherein pressure-testing comprises using the at least one port to adjust the pressure in the pressure chamber to verify the integrity of the seals of the device bodies.

Alternatively, providing comprises providing a system having a pair of device bodies spaced apart and defining the pressure chamber therebetween. Deploying may comprise the deploying actuator moving the at least two device bodies with respect to each other and wherein deploying comprises deploying the tubular while one of the device bodies is gripping the tubular. Deploying may comprise the at least a pair of spaced apart device bodies alternately gripping and sealing the tubular and thereby convey the tubular in at least one wellbore servicing operation, enabling the use of the device as an airlock deployment apparatus. Alternatively, deploying comprises deploying the tubular into the wellbore under pressure Embodiments of the apparatus, system and method of the present invention provides methods to solve problems with existing deployment systems and allow deploying tools of arbitrary geometry, robustness, and length into preferably pressurized wells.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1A:
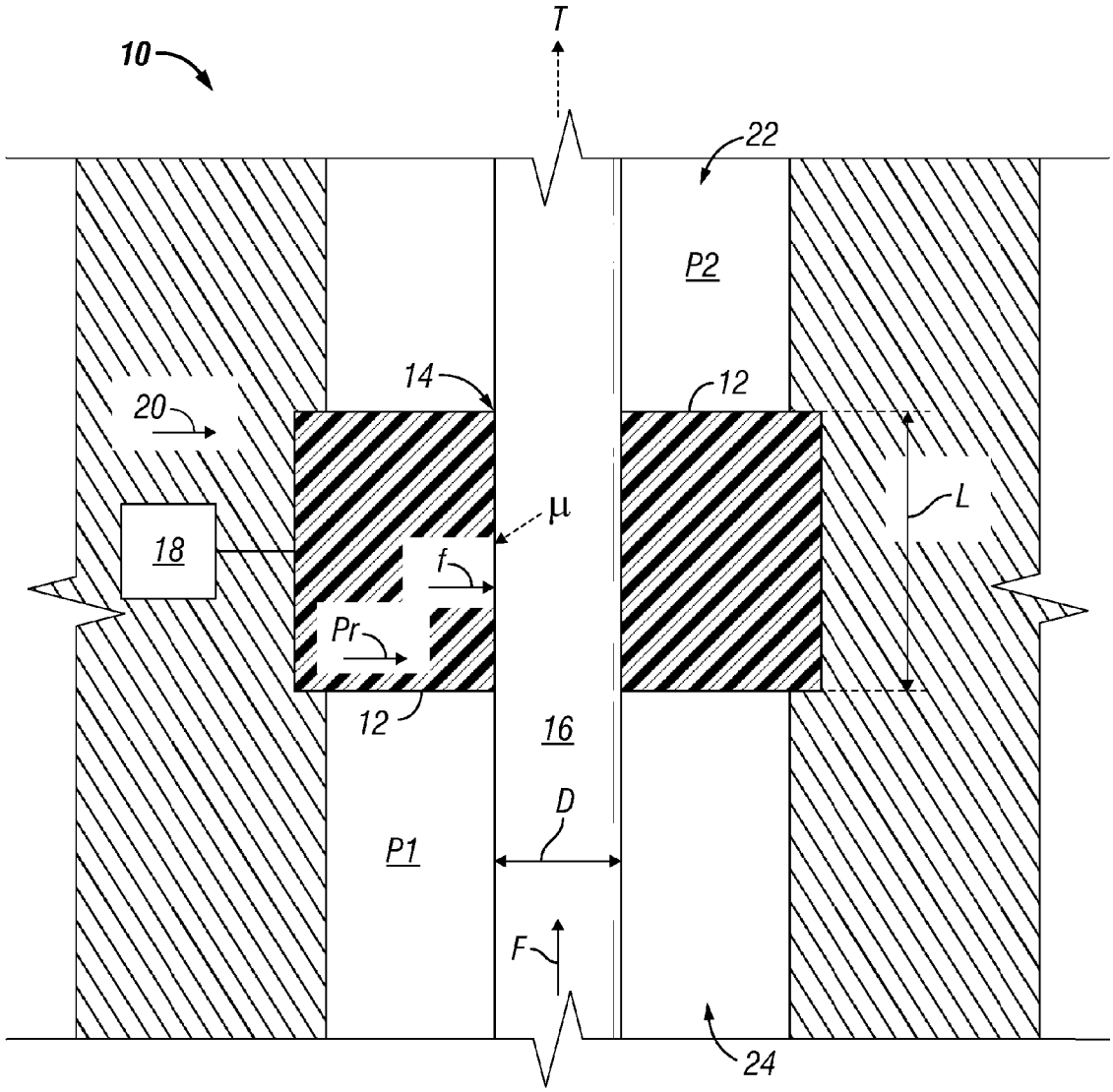
FIGS. 1*a* and 1*b* are schematic views, respectively, of an embodiment of an apparatus for engaging a tubular of the present invention shown in opened and closed positions.
Figure 1B:
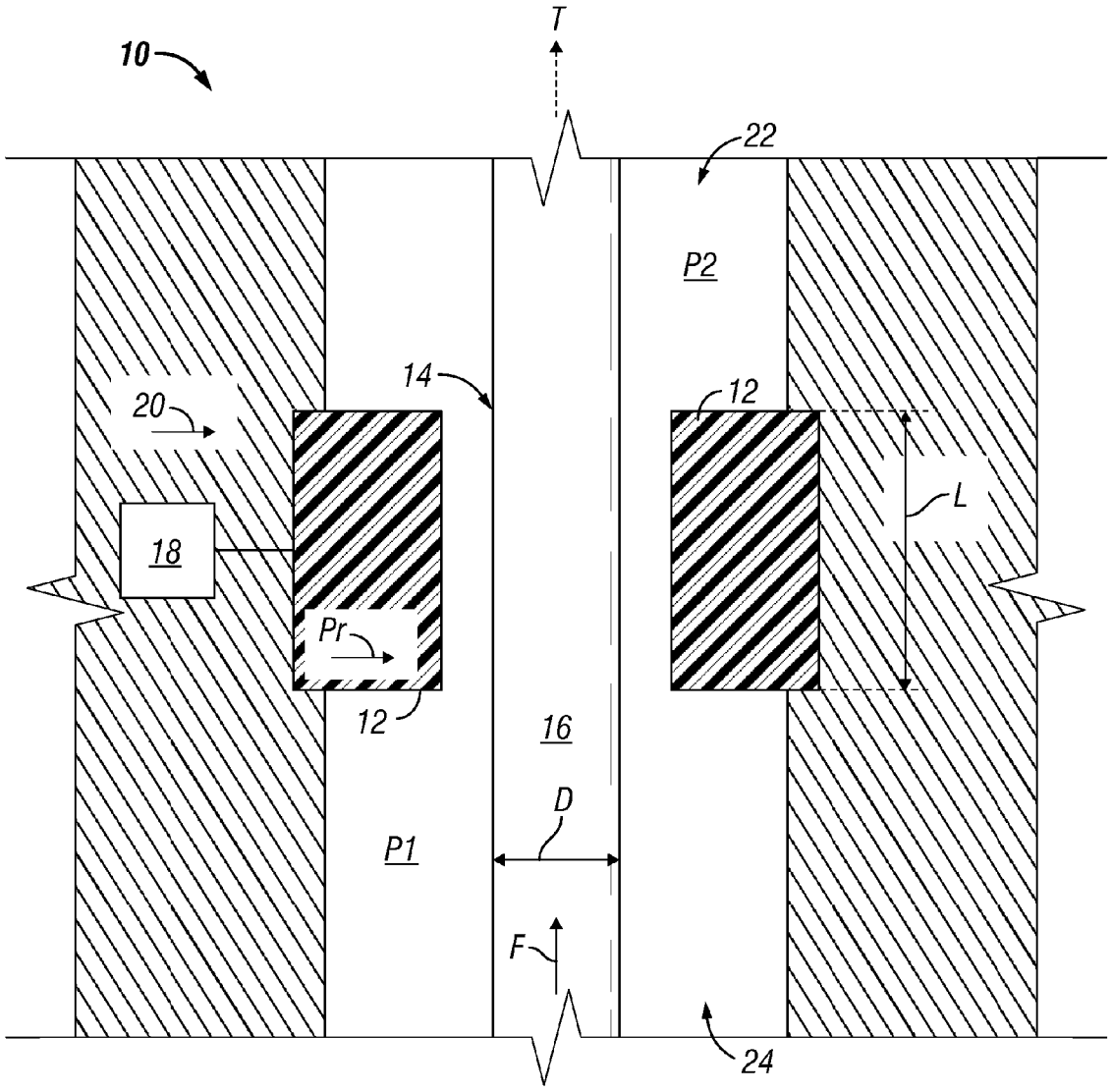
Figure 2:
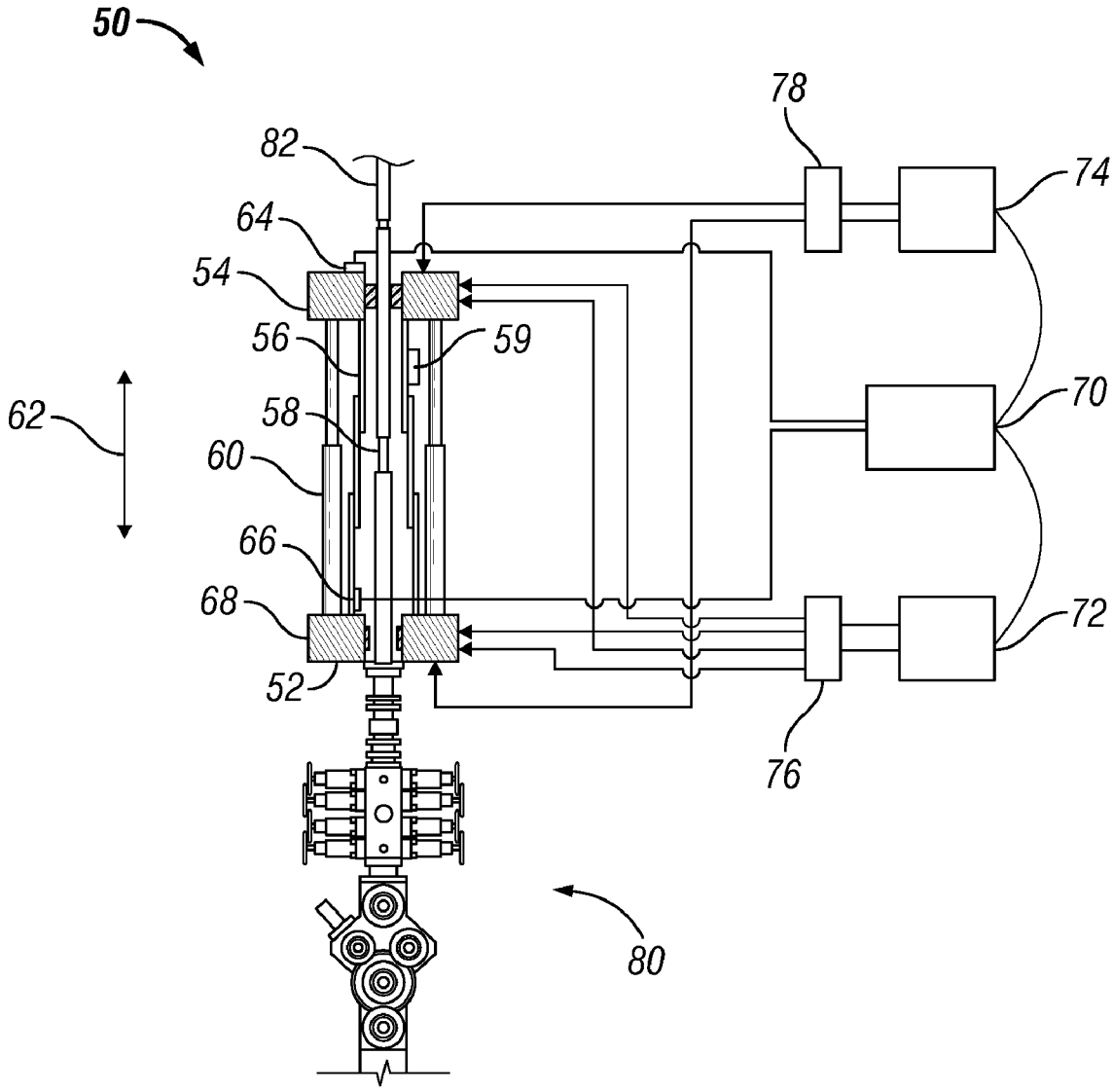
FIG. 2 is a schematic view of an embodiment of a system for providing a uniform flow output in accordance with the present invention.

Referring now to FIGS. 1*a* and 1*b*, there is shown a schematic embodiment of a tubular engaging apparatus in accordance with the present invention, indicated generally at 10. The apparatus 10 includes a device body, indicated generally at 12. The device body 12 defines an aperture 14 that extends through the body 12. The aperture 14 is preferably adjustably sized such that an internal surface defined by the aperture 14 engages with a tubular 16 in a second or closed position, shown in FIG. 1*a* but allows the passage of the tubular 16 therethrough in a first or opened position, shown in FIG. 1*b*.

The tubular 16 defines a diameter D and may be, but is not limited to, coiled tubing, wireline, a portion of a drill string, or the like. The tubular 16 may have any number of cross-sectional shapes including, but not limited to, circular, oval, rectangular, and the like and may or may not be substantially straight along its longitudinal axis. For instance, it may have circumferential features such as a groove or similar feature that will survive contact with the aperture mechanism.

An actuator 18 is operable to impart or provide a force in a direction indicated by an arrow 20 to firmly engage the internal surface of the device body 12 with the exterior surface of the tubular 16 along a length L. The actuator 18 may be, but is not limited to, a hydraulic or gas cylinder, a bladder actuated by gas or fluid pressure, mechanical actuation provided through a sealing mechanism, rotary hydraulic or pneumatic, well bore pressure acting on the gripping mechanism, an electrical motor or the like, or any suitable device or apparatus that may impart a force to an external surface of the device body 12. The device body 12 is preferably disposed in a housing (not shown) or the like that contains both the device body 12 and the actuator 18. Alternatively, the device body 12 is disposed in the housing and the actuator is disposed external of the housing. The device body 12 is preferably formed from an elastomeric material such as simple rubber, rubber (either in bulk or an inner layer) or the like. The material of the device body 12 is preferably mixed with a gripping substance, such as spherical particles, sharp pointed particles, oriented particles that are generally longer along one axis than the other or other suitable substances, as will be appreciated by those skilled in the art, to assist the device body in gripping the tubular 16. The device body 12 preferably includes reinforcement members (not shown) disposed therein to assist in firmly engaging the internal surface of the device body 12 with the exterior surface of the tubular 16.

The device body 12 is preferably situated between lower portion or region 22 having a predetermined pressure P1 and an upper portion or region 24 having a predetermined pressure P2. The pressure P2 is preferably, but is not limited to, atmospheric pressure. The pressure P1 is typically, but is not limited to, wellbore pressure and the pressure P1 is greater than pressure P2. A tension force T may be exerted on the tubular 16, such as by surface equipment or the like. A total force F, therefore, is exerted on the tubular 16, as recited in equation 1.

$$F = \pi\left(\frac{D}{2}\right)^2 \cdot P1 + T \qquad \text{(Equation 1)}$$

The force F on the tubular 16 is resisted by a pressure force f exerted by the device body 12 against the exterior surface of the tubular 16, defined by the coefficient of friction between the device body 12 and the tubular 16, μ, the Diameter D and length L, as shown in equation 2.

$$f = \mu \cdot \pi DL \cdot Pr \qquad \text{(Equation 2)}$$

The length L of the device body 12 is sized such that the force f in Equation 2 is greater than or equal to the force F in Equation 1, or:

$$f \geqq F,$$

then $$\mu\pi DL \cdot Pr = \pi\frac{D^2}{4} \cdot P1 + T,$$

if T is assumed equal zero, then $$\mu\pi DL \cdot Pr = \pi\frac{D^2}{4} \cdot P1,$$

and if Pr is approximately equal to P1, then $$4\mu L = D$$

and, therefore, $$L = \frac{D}{4\mu} \qquad \text{(Equation 3)}$$

As determined by Equation 3, the contact length, L, of the device body 12 is determined by the diameter, D, of the tubular 16, and by the coefficient of friction between the device body 12 and the tubular 16, μ. With the properly determined contact length L, the apparatus 10 will function similar to an annular BOP but will advantageously prevent the movement of a tubular 16 placed within the device body 12. The apparatus 10 will seal and grip on a predetermined range of outside diameters or dimensions of tubulars 16. The tubular 16 is not necessarily circular in cross section. The gripping by the device body 12 may be accomplished with simple rubber, rubber (either in bulk or an inner layer) mixed with a gripping substance, and/or metal inserts members placed such that they contact the tubular. Alternatively, at least a pair of device bodies 12 are stacked to define the predetermined grip length L.

The contact length L is generally longer to reduce the contact pressure Pr required for gripping the tubular 16. The apparatus 10, therefore, is a variable pipe slip or BOP that is suitable for engaging with tubulars 16 of varying diameter and cross-sectional shapes. A BOP composed of a tubular rubber sleeve is particularly suitable for the device body 12 apparatus 10. External hydraulic pressure causes the sleeve or device body 12 to squeeze in on the tubular 16. The hydraulic pressure Pr must exceed the well bore or well head pressure P1 to seal and/or grip the tubular 16. This sort of grip will automatically compensate for the additional gripping force required as well head pressure P1 increases because the hydraulic pressure required to close the BOP 12 increases with well head pressure, and the pressure required to grip at all is enough to maintain the grip on the tubular 16. Further, if the differential pressure between P1 and P2 increases while the hydraulic volume is maintained, the hydraulic pressure Pr will increase to match as the BOP 12 is pushed in the direction of the lower pressure.

Alternatively, if no tubular 16 is disposed within the device body 12, the force in the direction 20 will cause the device body 12 to collapse the interior walls of the aperture 14 and thereby completely close off the aperture 14, preventing pressure from the region 24 from moving the region 22, effectively closing an open hole and sealing the region 24 from well bore pressure. When actuated in this manner, the apparatus 10 acts as a blind or blind ram. Those skilled in the art will appreciate that utilizing the apparatus 10 as a blind or blind ram (i.e. wherein the device body 12 closes an open hole) will reduce the performance and durability of the device body as compared to utilizing the apparatus 10 to engage with a tubular 16 having a predetermined range of outside diameters, such as D.

Referring now to FIGS. 2-12, a system for engaging and deploying a tubular is indicated generally at 50. The system 50 includes a first device body 52 and a second device body 54 spaced apart from the first device body 52. The device bodies 52 and 54 are preferably operable to grip and seal objects disposed therein such as, but not limited to, variable pipe slips (i.e. wherein the device bodies 52 and 54 are operable to grip and seal a moving tubular 16), variable pipe/slip rams (i.e, wherein the device bodies 52 and 54 are operable to grip and seal an unmoving tubular 16), variable pipe BOPs, or variable pipe blinds (i.e. wherein the device bodies 52 and 54 are operable to close and seal an open hole as discussed above), including, but not limited to, the device body 12 shown in FIG. 1. The device bodies 52 and 54 preferably each define an aperture (not shown) therein. Alternatively, the device bodies 52 and 54 are conventional BOPs with one or more pipe, slip and/or pipe/slip rams. A telescopic tube 56 is disposed between and connects the device bodies 52 and 54. The interior of the telescope tube 56 preferably defines a pressure chamber, indicated generally at 58, that may be pressure tested. A port, indicated generally at 59, is in fluid communication with the pressure chamber 58 and a source of pressurized fluid (not shown) for pressurizing the pressure chamber 58, discussed in more detail below. The port 59 is also preferably in fluid communication with a low pressure area for venting, purging or releasing pressure from the pressure chamber 58. Alternatively, there are a plurality of ports 59 provided to pressurize or vent the pressure chamber 58. Alternatively, a single device body 52 or 54 may incorporate a zone that can be tested. For example, if the device bodies 52 and 54 consist of two variable pipe slip rams, the space between the two rams may be tested for pressure tightness using a valve leading to the pressure testing system. This, in turn, verifies that pressure cannot pass through the bodies 52 or 54 if the pressure testing valve is closed. Alternatively, the device bodies 52 and 54 are disposed within the pressure chamber 58. Alternatively, one of or each of the device bodies 52 and 54 are a pair of device bodies.

At least one deploying or conveying actuator 60 is attached to each of the device bodies 52 and 54. The actuator 60 is operable to move the device body 54 in directions indicated by an arrow 62 with respect to the device body 52, which is preferably fixed in position. The actuator 60 is preferably a hydraulic cylinder, screw mechanism, rack and pinion, chain drive, or any other linear actuation system, as will be appreciated by those skilled in the art. Alternatively, the actuator 60 is operable to move the device body 52 in the directions indicated by an arrow 62 with respect to the device body 54. Suitable sensors, such as an electromagnetic sensor 64, a pressure sensor 66, a load cell 68, or similar sensors are disposed adjacent the device bodies 52 and 54 and actuator 60 to provide control signals to a controller 70 or the like during operation of the system 50, discussed in more detail below. Alternatively, sensors 64 and 66 may be an ultrasonic sensor, an electromagnetic sensor, a magnetic sensor, a pressure sensor, or combinations thereof.

A first pressurizing unit or device body actuator 72 is in communication with at least the first device body 52 and a second pressurizing unit or device body actuator 74 is in communication with at least the second device body 54. Alternatively, the pressurizing units 72 and 74 are in communication with each of the first 52 and second device bodies 54. The pressurizing units 72 and 74 may be any suitable actuator including, but not limited to, an electric actuator, a hydraulic actuator, a pneumatic actuator, screw mechanism, rack and pinion, chain drive, or any other linear actuation system, as will be appreciated by those skilled in the art, or the like. The pressurizing units 72 and 74 are similar to the actuator 18 of FIG. 1 and are operable to move to impart or provide a force in a direction indicated by an arrow 20 to move the respective internal surfaces of the device bodies 52 and 54 adjacent the respective apertures inwardly to engage with an object or objects disposed therein or with the opposing walls of the device bodies 52 and 54 in the case of a variable pipe blind. The pressurizing units 72 and 74 may be further connected to appropriate valves 76 and 78 or the like for directing a pressurizing fluid to the pressure chamber 58. The valves 76 and 78 are also preferably in communication with the controller 70. The system 50 is adapted to be mounted or attached to a well head assembly, indicated generally at 80 and to receive and subsequently deploy a bottom hole assembly (BHA), indicated generally at 82. The BHA 82 may be, but is not limited to, a logging tool, a mill and motor, an inflatable packer, a jet cleaning tool, a downhole tractor, and the like.

Figures 3, 4, 5, 6:
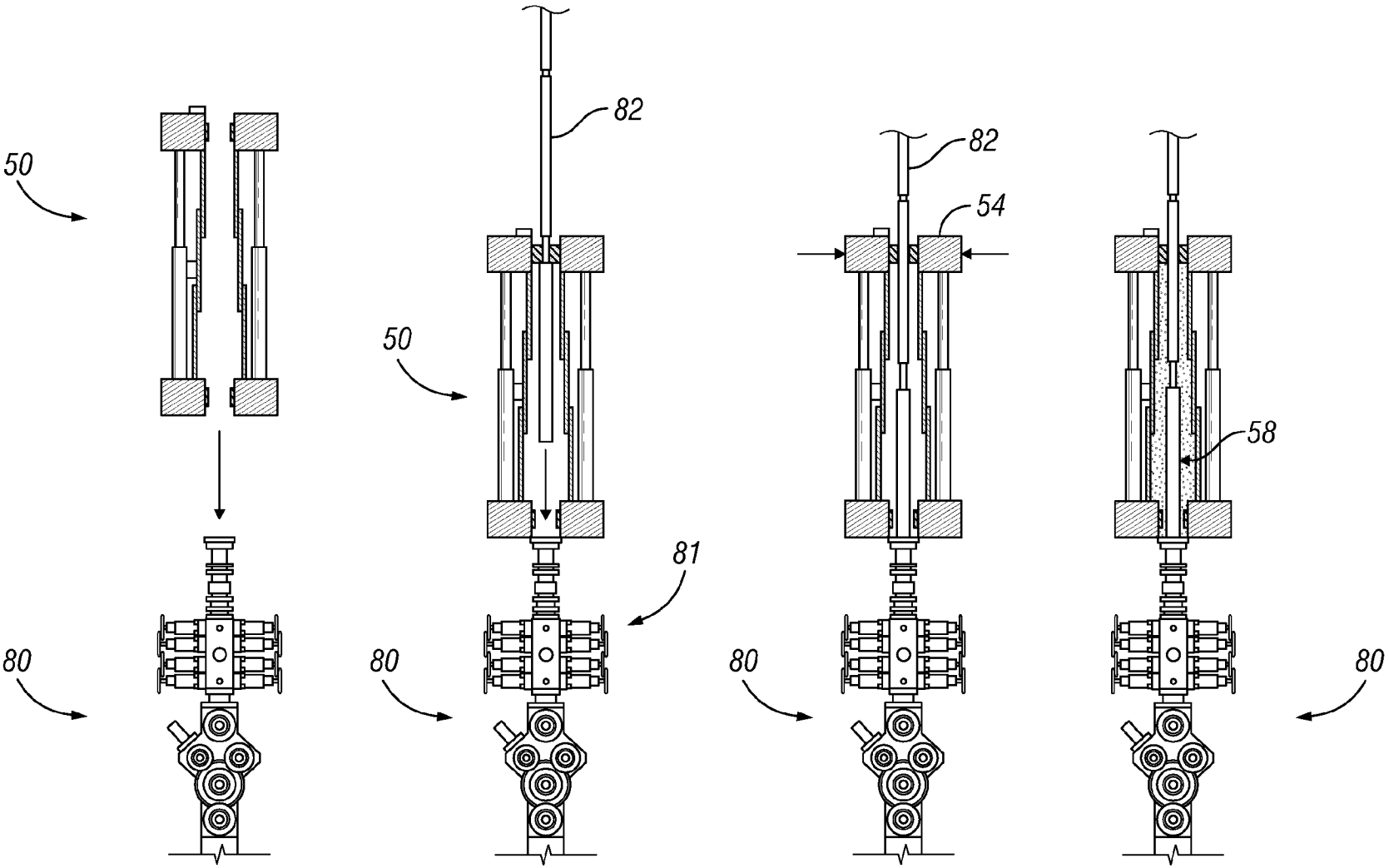
FIGS. 3-12 are schematic views, respectively, of the system of FIG. 2 in operation.

Referring now to FIGS. 3-12, in operation, the system 50 is installed on top of the well head assembly 80, as shown in FIG. 3. In FIG. 4, the BHA 82 is inserted into the system 50 and wellhead assembly 80 until the BHA 82 reaches the BOP ram 81 (point to top ram of quad BOP). In FIG. 5, the device body 54 is actuated by the pressurizing unit 72 or 74 to grip the BHA 82 and close off or isolate the pressure chamber 58. In FIG. 6, the pressure chamber 58 is pressurized through the port 59 and the pressure within the pressure chamber 58 is monitored (such as through the port 59 or the like) to determine the effectiveness of the seal between the device body 54, the wellhead assembly 80, and the BHA 82. Pull tests on the BHA 82 may also be conducted at this time using the means to insert the BHA 82 or the like.

Figures 7, 8, 9, 10:
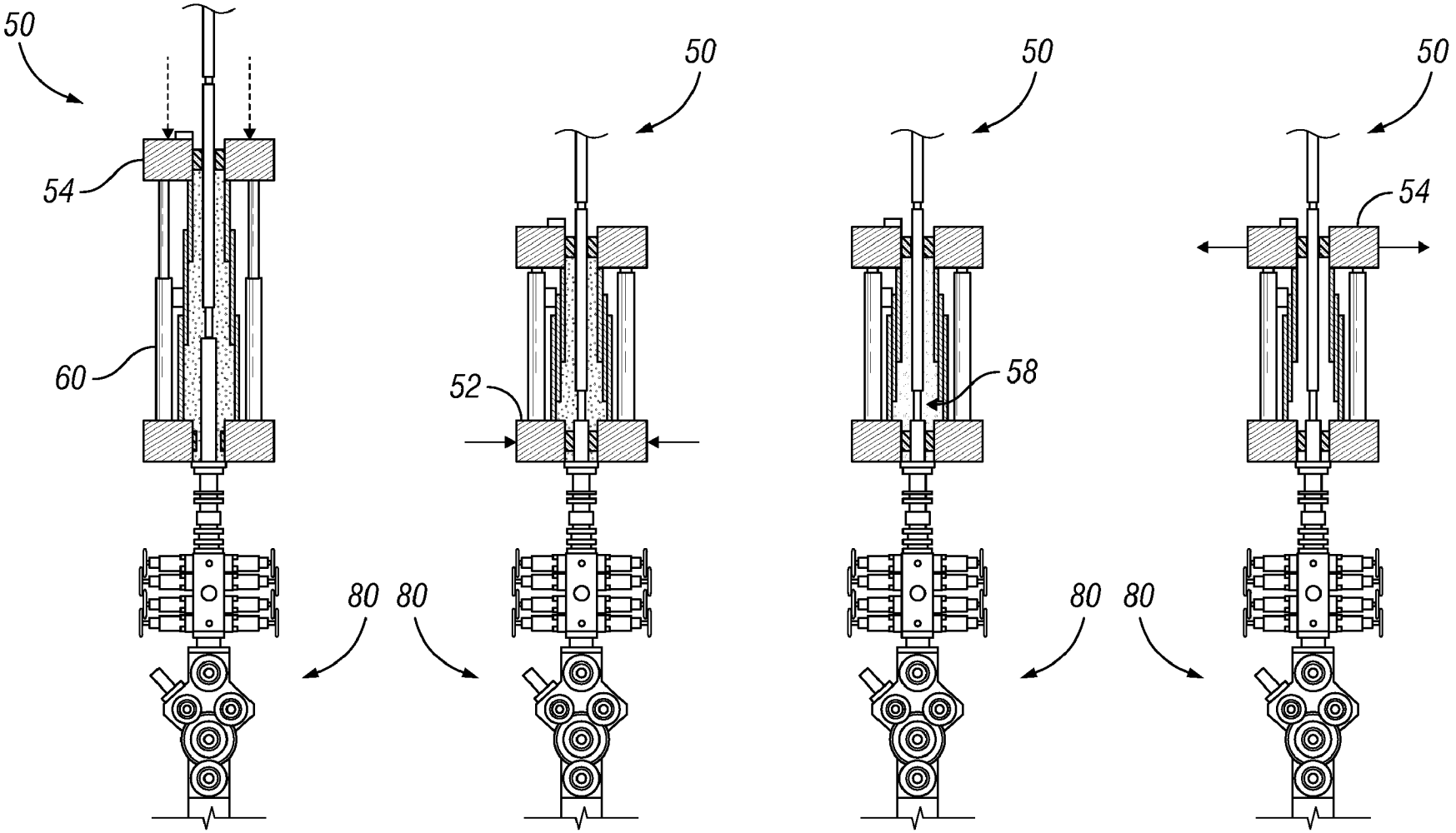
Figure 12:
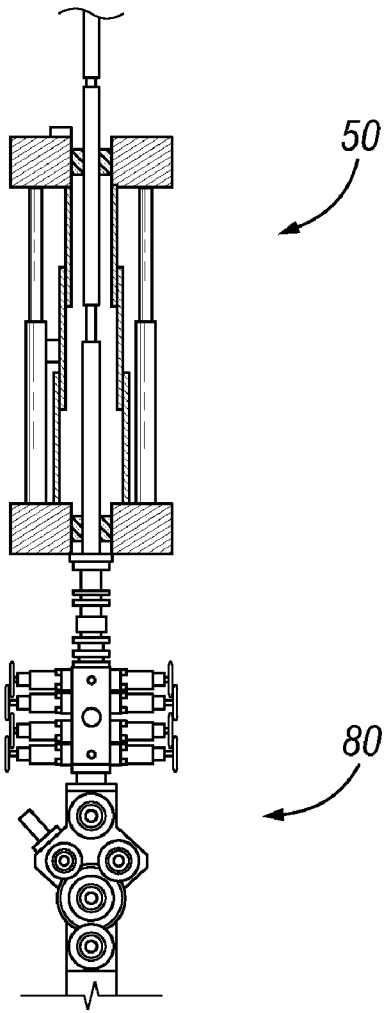

In FIG. 7, once the pressure in the pressure chamber 58 is equalized, the BOP ram 81 and the valves on the well head 80 are opened and the actuator 60 is activated to move the device body 54 downwardly towards the device body 52 and the wellhead assembly 80. This process moves the BHA 82 inside the wellhead assembly 80. In FIG. 8, once the desired position is reached, the device body 52 is actuated by the pressurizing unit 72 or 74 to grip the BHA 82.

Figure 11:
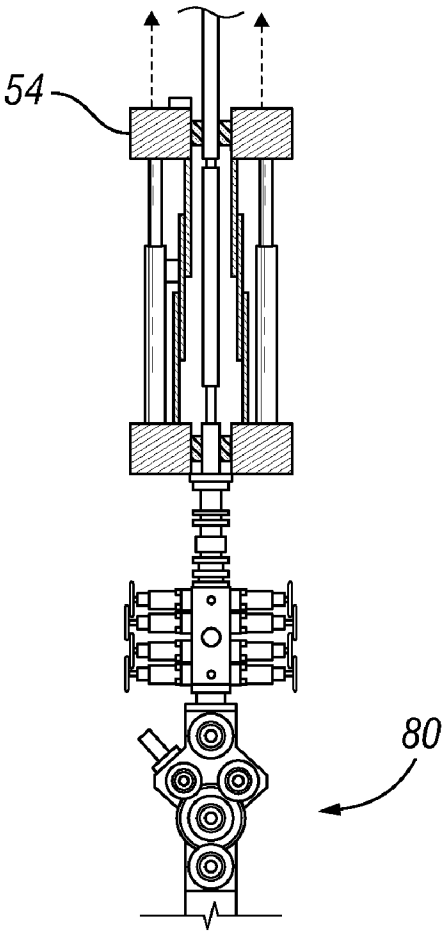

In FIG. 9, the pressure in the pressure chamber 58 is released and the volume may be purged with an appropriate medium to prevent the release of well bore fluids, while monitoring the pressure in the pressure chamber 58 (such as through the port 59 or the like) to determine the effectiveness of the seals of the device body 52, device body 54, and to ensure well bore fluid is not leaking into the pressure chamber 58. Alternatively, the volume in chamber 58 may be purged by forcing an appropriate purging medium into port 59 and down into the well bore, replacing the well bore fluids with another, preferably non-hazardous medium, such as, but not limited to, water, brine, nitrogen, and carbon dioxide, as will be appreciated by those skilled in the art. In this case, it may be advantageous to partially close device body 52 in order to retain the purging medium. A pull test of device bodies 52 and 54 may be performed at this point using actuator 60 to verify that the device bodies are capable of retaining the BHA against the well bore pressure. Once the pressure in the pressure chamber 58 is purged or released (such as through the port 59 or the like), in FIG. 10, the device body 54 is released from the BHA 82. In FIG. 11, the actuator 60 is activated to move the device body 54 upwardly away from the device body 52 and wellhead assembly 80 and, when the desired position is reached in FIG. 12, the steps shown in FIGS. 5-11 are repeated until the BHA 82 is successfully deployed in the wellhead assembly 80.

The system 50 may be advantageously utilized to deploy BHAs 82 of varying length, as will be appreciated by those skilled in the art. For example, the actuator 60 need not activate for its entire stroke and may be advantageously varied in operation in order to bypass sensitive or significant areas of the tool or BHA 82 and thereby not damage the tool or BHA 82. In addition, significant and/or sensitive areas of the BHA 82 can be advantageously bypassed such that neither of the device bodies 52 or 54 is gripping or sealing on the significant area of the BHA 82. For example, with the device bodies 52 or 54 having a length of substantially two feet and an actuator 60 having a stroke of substantially twenty feet, the bypassed areas on the BHA 82 are up to sixteen feet, while the grip area of the device bodies 52 and 54 is a four foot section. In general, it is advantageous for the actuator to move the device body 54 as close as possible to the device body 52 in order to maximize the bypassed areas for each stroke. Further, the higher the ratio of the extended to retracted length of actuator 60, the more effective the system 50, subject to the drawback of increasing complexity. The optimal construction for the adjustable length section and thereby the pressure chamber 58 between device bodies 52 and 54 comprises one to four sliding seals, each attached to a concentric pressure barriers and allowing motion between such barriers while maintaining a seal This is more preferably accomplished with two sliding seals and the attendant concentric pressure barriers. Such sliding seals may include O-rings, chevron packings, u-cup seals, pressure actuated seals, piston rings, close clearance areas designed to leak at a controlled rate, close clearance areas provided with a working fluid to both leak out and leak in at a controlled rate, as will be appreciated by those skilled in the art. Certain types of actuating systems are more or less effective as the extended to retracted ratio increases. For example, screw driven or rack gear driven systems can offer very high ratios of extended to retracted length, but will generally protrude far beyond the active area. A telescoping hydraulic cylinder generally provides less force the larger the ratio between extended and retracted length due to the need to nest more and more telescoping sections. The smallest section always delivers less force that the largest section due to the change in cross sectional area.

The pressure chamber 58 may also comprise, but is not limited to, other variable length chambers including; a bellows, a flexible tube, a shape memory device that changes length, at least a pair of sleeves fastened together, such as by a threaded connection, and the like, as will be appreciated by those skilled in the art. Alternatively, the device bodies 52 and 54 are disposed within the pressure chamber 58.

The port 59 provides an advantageous means for pressure testing the system 50. The port 59 may be used to adjust the pressure in the pressure chamber 58 between the device bodies 52 and 54 to verify and/or improve the seal integrity of the device bodies 52 and 54 and/or to improve the gripping by the device bodies 52 and 54. In the case of device bodies 52 and 54 whose gripping force depends on differential pressure, the pressure between device bodies 52 and 54 may be raised or lowered to improve their performance. A material to improve the friction (such as sand) and/or plug leaks (such as fiber, sand, or viscous fluids) may be pumped into this space and through device bodies 52 and/or 54.

Alternatively, relative motion between two device bodies 52 and 54 is utilized to verify the gripping strength of the device bodies 52 and 54 by activating the actuator 60 with each of the device bodies 52 and 54 actuated and gripping the BHA 82. If the BHA 82 is stretched or compressed, the gripping strength of the device bodies 52 and 54 is verified.

Alternatively, relative motion between the two device bodies 52 and 54 is utilized to provide load equalizing between the two device bodies 52 and 54 by locating the device bodies 52 and 54 close to each other and placing an actuator (similar to the actuator 60) between the device bodies 52 and 54 and moving one of the device bodies 52 and 54 a short distance after the device bodies 52 and 54 have been actuated.

Alternatively, the device bodies 52 and 54 do not move relative to one another and the actuator 60 engages with the BHA 82 in another manner to deploy the BHA into the wellbore.

Alternatively, the device body 54 is an annular BOP that allows the BHA 82 to slide therethrough while sealing against the BHA 82 (i.e. the device body 54 functions as a variable pipe slip). As such, the BHA 82 may be pulled (such as by the actuator 60 or the like) into the pressure chamber 58 and ultimately the wellbore while the pressure chamber 58 is tested, which advantageously decreases the time to deploy the BHA 82 and reduces the cycles required to actuate the device body 54. Alternatively, the apparatus 10 or system 50 is utilized sub-sea to prevent seawater from entering the area defined between the device body 12 and the tubular 14 and/or the pressure chamber 58.

Figure 13:
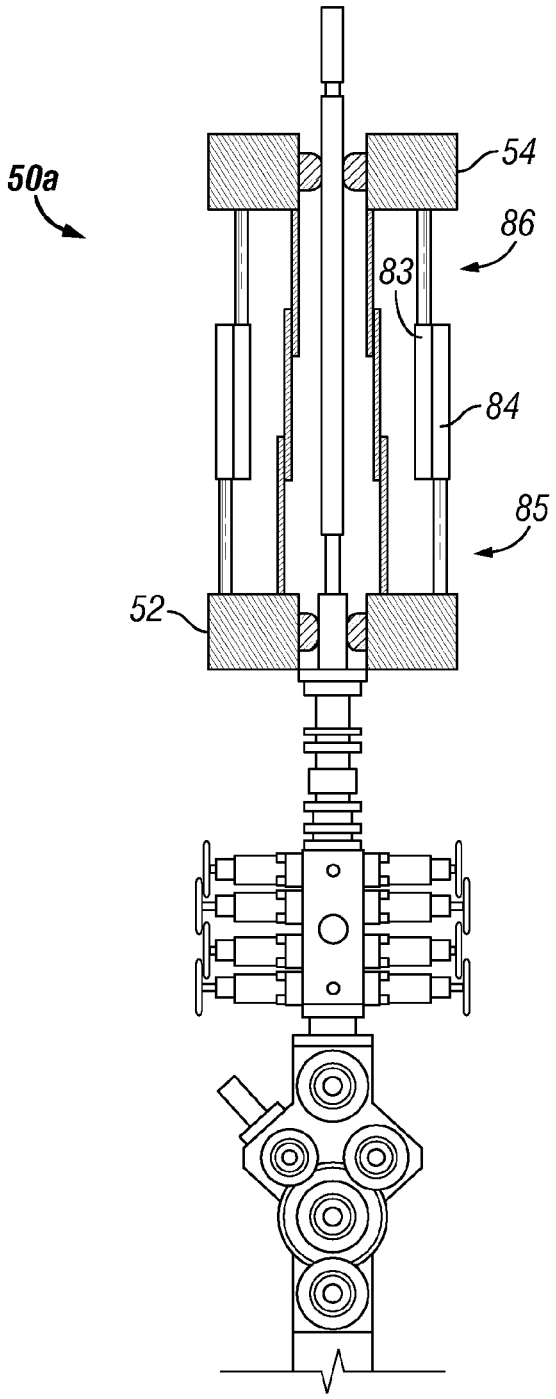
FIG. 13 is a schematic view of an alternative embodiment of a system for providing a uniform flow output in accordance with the present invention.

Referring now to FIG. 13, an alternative embodiment of a system for engaging and deploying a tubular is indicated generally at 50*a*. The system 50*a* includes a radially outer hydraulic cylinder and rod assembly 85 having a cylinder 83 attached to a cylinder 84 of a radially inner hydraulic cylinder and rod assembly 86. The rod of the assembly 85 is attached to the device body 52 and the rod of the assembly 86 is attached to the device body 54. In this embodiment, the need to have very large forces to move the device body 54 up and down against the well bore pressure means that moving the cylinders 83 and 84 of the assemblies 85 and 86 maximizes the ratio while still retaining the advantage of large forces. Alternatively, the position of the rods and cylinders 83 and 84 of the assemblies 85 and 86 may be swapped to further increase the available force.

Figure 14:
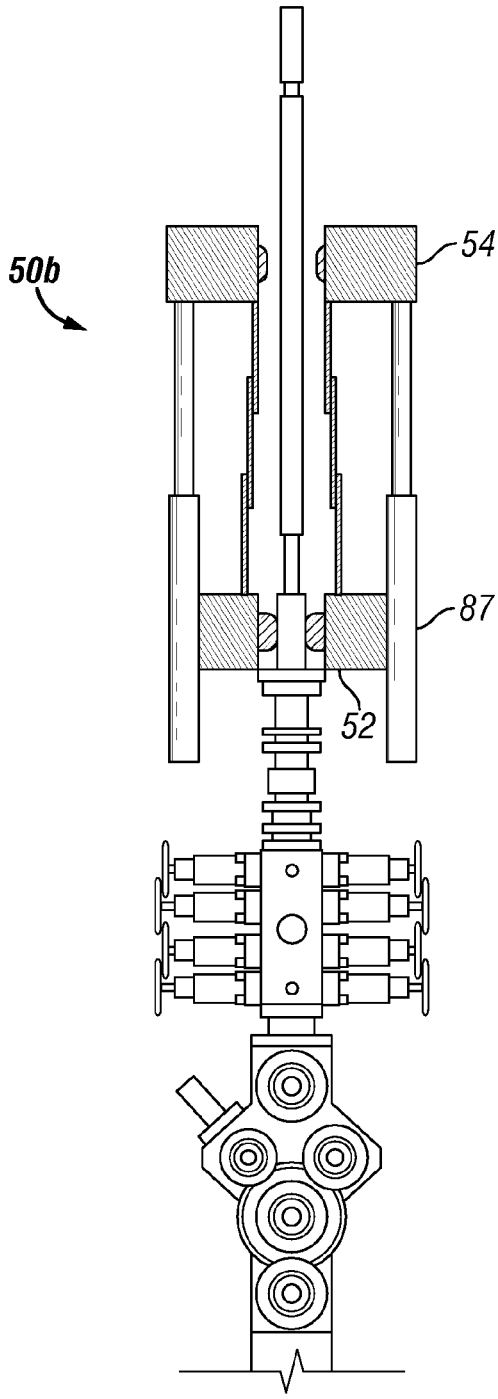
FIG. 14 is a schematic view of an alternative embodiment of a system for providing a uniform flow output in accordance with the present invention.

Referring now to FIG. 14, an alternative embodiment of a system for engaging and deploying a tubular is indicated generally at 50*b*. In this embodiment, the cylinder body 87 protrudes below the device body 52, which advantageously increases the extended to retracted length of the system 50*b* and allows the retraction and extension forces to be substantially equal, which is an advantage over telescoping cylinders.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. An apparatus for engaging with an outside diameter of a tubular, comprising:

at least one device body having an internal surface, the internal surface defining an internal diameter in a first position and allowing the tubular to pass therethrough;

an actuator operable to move the internal surface of the at least one device body from the first position to a second position, the second position defining an internal diameter less than the first position internal diameter, wherein the internal surface of the device body is sized with a predetermined grip length for engaging with the outside diameter of the tubular, the grip length determined by a function of the outside diameter of the tubular and the coefficient of friction between of the outside diameter of the tubular and the interior surface of the device body and wherein the device body is operable to engage with a tubular having a predetermined range of outside diameters, wherein the predetermined grip length, L, is determined by the equation $$L = \frac{D}{4\mu},$$

wherein D is the outside diameter of the tubular and μ is the coefficient of friction.

2. The apparatus according to claim 1 wherein the predetermined grip length is further determined by a predetermined pressure below the at least one device body, a predetermined tension force exerted on the tubular, and a predetermined pressure above the at least one device body.

3. The apparatus according to claim 1 wherein at least a pair of device bodies are stacked to define the predetermined grip length.

4. The apparatus according to claim 1 wherein the at least one device body is operable to simultaneously seal and convey the tubular.

5. The apparatus according to claim 1 wherein the at least one device body is operable to simultaneously seal and grip the tubular.

6. The apparatus according to claim 1 wherein the at least one device body is operable to prevent relative motion of the tubular.

7. The apparatus according to claim 1 wherein the tubular is one of coiled tubing, wireline, a downhole tool, and at least a portion of a drill string.

8. The apparatus according to claim 1 wherein the actuator is selected from the group consisting of a hydraulic actuator, a pneumatic actuator, an electrical actuator, a mechanical actuator, and combinations thereof.

9. A system for deploying a tubular in a wellbore, comprising:

at least one device body having an internal surface, the internal surface defining an internal diameter in a first position and allowing the tubular to pass therethrough;

a device body actuator operable to move the internal surface of the at least one device body from the first position to a second position, the second position defining an internal diameter less than the first position internal diameter to enable the internal surface of the at least one device body to grip and seal the tubular, wherein said internal surface is made of a same material;

a pressure chamber adjacent the at least one device body for testing the seal of the at least one device body prior to exposing the pressure chamber to wellbore pressure; and a deploying actuator operable to deploy the tubular by using the gripping force of the internal surface of the device body and providing the entire gripping force necessary to deploy the tubular in a wellbore, wherein the system is operable to be attached to a wellhead assembly and wherein the at least one device body is operable to engage with a tubular having a predetermined range of outside diameters;

wherein the internal surface of the device body is sized with a predetermined grip length for engaging with the outside diameter of the tubular, the grip length determined by a function of the outside diameter of the tubular and the coefficient of friction between of the outside diameter of the tubular and the interior surface of the device body and wherein the device body is operable to engage with a tubular having a predetermined range of outside diameters, wherein the predetermined grip length, L, is determined by the equation $$L = \frac{D}{4\mu},$$

wherein D is the outside diameter of the tubular and μ is the coefficient of friction.

10. The system according to claim 9 wherein the internal surface of the device body is sized with a predetermined grip length for engaging with the outside diameter of the tubular, the grip length determined by a function of the outside diameter of the tubular and the coefficient of friction between of the outside diameter of the tubular, the interior surface of the device, a predetermined pressure below the at least one device body, a predetermined tension force exerted on the tubular, and a predetermined pressure above the at least one device body.

11. The system according to claim 9 further comprising at least one port in fluid communication with the pressure chamber and at least a source of pressurized fluid and wherein the at least one port is operable to adjust the pressure in the pressure chamber to verify the integrity of the seals of the device bodies.

12. The system according to claim 9 wherein the at least one device body is at least a pair of spaced apart device bodies and wherein the pressure chamber is disposed between the device bodies.

13. The system according to claim 12 wherein the deploying actuator is operable to move the at least two device bodies with respect to each other and wherein the system deploys the tubular while one of the device bodies grips the tubular.

14. The system according to claim 12 wherein the at least a pair of spaced apart device bodies alternately grip and seal the tubular and thereby convey the tubular in at least one wellbore servicing operation, enabling the use of the system as an airlock deployment apparatus.

15. The system according to claim 12 wherein the device bodies are disposed within the pressure chamber.

16. The system according to claim 12 wherein relative motion between the device bodies is utilized to verify the gripping strength of the device bodies.

17. The system according to claim 9 wherein the pressure chamber is a telescopic tube.

18. A method for deploying a tubular in a wellbore, comprising:

providing a system for deploying a tubular, the system comprising at least one device body having an internal surface made of a same material and operable to at least grip and seal the tubular, a pressure chamber, and a deploying actuator to deploy the tubular;

attaching the system to a wellhead assembly;

inserting the tubular into the system;

sealing the tubular with the at least one device body;

pressure-testing the system in the pressure chamber without exposing the pressure chamber to wellbore pressure; and deploying the tubular into the wellbore by using the gripping force of the internal surface of the device body providing the entire gripping force necessary to deploy the tubular into the wellbore;

wherein the internal surface of the device body is sized with a predetermined grip length for engaging with the outside diameter of the tubular, the grip length determined by a function of the outside diameter of the tubular and the coefficient of friction between of the outside diameter of the tubular and the interior surface of the device body and wherein the device body is operable to engage with a tubular having a predetermined range of outside diameters, wherein the predetermined grip length, L, is determined by the equation $$L = \frac{D}{4\mu},$$

wherein D is the outside diameter of the tubular and μ is the coefficient of friction.

19. The method according to claim 18 wherein providing comprises providing at least one of a variable pipe slip, a variable slip ram, and a variable pipe ram to at least grip and seal the tubular.

20. The method according to claim 18 wherein sealing and deploying are performed substantially simultaneously.

21. The method according to claim 18 wherein deploying comprises gripping the tubular with at least one device body and activating the deploying actuator to move the tubular into the wellbore.

22. The method according to claim 18 further comprising purging the pressure chamber and repeating the sealing, pressure-testing, deploying and purging steps until the tubular is deployed into the wellbore.

23. The method according to claim 18 wherein inserting comprises inserting one of coiled tubing, wireline, a downhole tool, and at least a portion of a drill string.

24. The method according to claim 18 wherein providing comprises providing a system having a pair of device bodies spaced apart and defining the pressure chamber therebetween.

25. The method according to claim 24 wherein providing further comprises providing at least one port in fluid communication with the pressure chamber and at least a source of pressurized fluid and wherein pressure-testing comprises using the at least one port to adjust the pressure in the pressure chamber to verify the integrity of the seals of the device bodies.

26. The method according to claim 24 wherein deploying comprises the deploying actuator moving the at least two device bodies with respect to each other and wherein deploying comprises deploying the tubular while one of the device bodies is gripping the tubular.

27. The method according to claim 24 wherein deploying comprises the at least a pair of spaced apart device bodies alternately gripping and sealing the tubular and thereby convey the tubular in at least one wellbore servicing operation, enabling the use of the device as an airlock deployment apparatus.

28. The method of claim 18 wherein deploying comprises deploying the tubular into the wellbore under pressure.

* * * * *